US005706044A

United States Patent [19]

Fukushima

[11] Patent Number: 5,706,044

[45] Date of Patent: Jan. 6, 1998

[54] THERMAL HEAD APPARATUS

[75] Inventor: Itaru Fukushima, Tokyo, Japan

[73] Assignee: NEC Corporation, Tokyo, Japan

[21] Appl. No.: 575,530

[22] Filed: Dec. 20, 1995

[30] Foreign Application Priority Data

Dec. 20, 1994 [JP] Japan ..... 6-316728

[51] Int. Cl.[6] ..... B41J 2/35; B41J 2/355

[52] U.S. Cl. ..... 347/211; 347/194

[58] Field of Search ..... 347/194, 211; 402/120.14

[56] References Cited

U.S. PATENT DOCUMENTS

| | | | |
|---|---|---|---|
| 5,132,709 | 7/1992 | West . | |
| 5,353,044 | 10/1994 | Nakano et al. | 347/211 |
| 5,422,662 | 6/1995 | Fukushima et al. | 347/211 |

FOREIGN PATENT DOCUMENTS

| | | |
|---|---|---|
| 0562626 | 9/1993 | European Pat. Off. . |
| 0595095 | 5/1994 | European Pat. Off. . |
| 3-82564 | 4/1991 | Japan . |
| 4-73166 | 3/1992 | Japan . |
| 5-8422 | 1/1993 | Japan . |

OTHER PUBLICATIONS

Patent Abstracts of Japan, vol. 8, No. 274 (M-345) [1711], Dec. 14, 1984.

Patent Abstracts of Japan, vol. 7, No. 92 (M-208) [1237], Apr. 16, 1983.

Patent Abstracts of Japan, vol. 12, No. 267 (M-722) [3114], Mar. 2, 1988.

Patent Abstracts of Japan, vol. 9, No. 264 (M-423) [1987], Oct. 22, 1985.

*Primary Examiner*—Huan H. Tran

*Attorney, Agent, or Firm*—Sughrue, Mion, Zinn, Macpeak & Seas, PLLC

[57] ABSTRACT

The present provides a thermal head apparatus wherein temperatures of heat generation elements resulted from heat generation can be individually detected directly so that an abnormal condition of any heat generation element can be detected. A plurality of unit heat generation elements each formed from a resistor whose electric resistance value varies depending upon a temperature of itself are arranged in a row. A driving circuit is provided for each unit heat generation element and supplies an electric current to the unit heat generation element, and a temperature detection circuit is provided for each unit heat generation element and extracts, from the unit heat generation element, an electric signal which is obtained as a result of a variation of a resistance value caused by a variation in temperature of the unit heat generation element itself. An abnormal condition detection circuit is provided for each unit heat generation element and detects presence or absence of an abnormal condition of the unit heat generation element from an output of the temperature detection circuit.

6 Claims, 3 Drawing Sheets

THERMAL HEAD APPARATUS

BACKGROUND OF THE INVENTION

1. Field of the Invention

This invention relates to a thermal head apparatus for use with a thermal printer.

2. Description of the Prior Art

A conventional thermal head apparatus for use with a thermal printer employs, as a unit heat generation element, a resistor member whose electric resistance value does not change depending upon the temperature but always exhibits a fixed resistance value. In order to detect the temperature of the thermal head apparatus, the thermal head apparatus includes a single temperature detection element for exclusive use, by means of which an overall temperature of the thermal head apparatus resulted from heat generation from a large number of unit heat generation elements is detected.

For example, In a thermal head apparatus disclosed in Japanese Patent Laid-Open Application No. Helsei 3-82564, in the proximity of a location where a large number of heat generation elements arranged in a row are located, a single thermistor is disposed as a temperature detection element common to the heat generation elements so that the temperature resulted from heat generation of the large number of heat generation elements is detected by the single thermistor. Then, the wave height value or the pulse width of a driving pulse for driving the large number of heat generation elements is controlled in response to the output of the thermistor so that, even if the temperature varies, uniform printing density can be obtained.

However, where the overall temperature of the set of heat generation elements is detected indirectly using the temperature detection element for exclusive use separate from the heat generation elements in this manner, only a macroscopic temperature around a plurality of heat generation elements which have been energized can be detected, but microscopic temperatures of the individual heat generation elements resulted from heat generation by them cannot be detected.

Consequently, an abnormal condition of each individual heat generation element cannot be detected. For example, if a fine foreign article which obstructs a normal printing operation such as a fine metal piece, a hair, a minute stone piece or a fine piece of paper is present on the front surface or the rear surface of, for example, thermosensible paper sheet or a thermal transfer ink film, then heat generated by the heat generation elements of the thermal head is prevented from being transmitted regularly to the thermosensible paper or the heat transfer ink film by the foreign article. Consequently, a drop or miss of printing occurs. In this instance, the heat generation element or elements at which the foreign article is present generate heat excessively. However, since the temperature is not detected for each of the heat generation elements, such miss of printing by the fine foreign article cannot be prevented.

Also when the characteristic of a particular heat generation element is varied, during normal printing operation, in a different manner from that of the other heat generation elements so that the heat generation element generates a reduced amount of heat or when a driving circuit for a particular heat generation element is disconnected so that it does not generate heat any more, this cannot be detected immediately.

SUMMARY OF THE INVENTION

It is an object of the present invention to provide a thermal head apparatus wherein temperatures of heat generation elements resulted from heat generation by them can be detected directly for the individual heat generation elements so that an abnormal condition of a heat generation element can be detected for the individual heat generation elements.

It is another object of the present invention to provide a thermal head apparatus wherein a miss of printing when a fine foreign article is present can be prevented.

It is a further object of the present invention to provide a thermal head apparatus wherein insufficient heat generation of a heat generation element or disconnection of a driving circuit for a heat generation element can be detected for individual heat generation elements.

In order to attain the objects described above, according to the present invention, there is provided a thermal head apparatus, which comprises a plurality of heat generation elements as unit heat generation elements each formed from a resistor member whose electric resistance value varies depending upon a temperature of itself and arranged in a row, a driving circuit provided for each of the unit heat generation elements for supplying an electric current to the corresponding unit heat generation element, a temperature detection circuit provided for each of the unit heat generation elements for extracting, from the corresponding unit heat generation element, an electric signal which is obtained as a result of a variation of a resistance value caused by a variation in temperature of the corresponding unit heat generation element itself, and an abnormal condition detection circuit provided for each of the unit heat generation elements for detecting presence or absence of an abnormal condition of the corresponding unit heat generation element from an output of the corresponding temperature detection circuit.

In the thermal head apparatus, a resistor member whose electric resistance value varies depending upon the temperature of itself is used as a unit heat generation element, and an electric signal is obtained from a variation in resistance value of each unit heat generation element which is resulted from a variation in temperature of the unit heat generation element itself so that each unit heat generation element individually serves also as a temperature detection element. Thus, the temperatures of the unit heat generation elements are individually detected directly. Accordingly, an abnormal condition of any unit heat generation element can be individually detected accurately.

Each of the abnormal condition detection circuits may include an outputting element for outputting an abnormal condition notification signal to the outside in synchronism with a timing signal inputted cyclically to the abnormal condition detection circuit.

Alternatively, each of the abnormal condition detection circuits includes a control element for turning the corresponding driving circuit off when the output of the corresponding temperature detection circuit representing the temperature of the corresponding unit heat generation element exceeds a threshold value.

Or, each of the abnormal condition detection circuits may include an outputting element for outputting an abnormal condition notification signal to the outside when the output of the corresponding temperature detection circuit representing the temperature of the corresponding unit heat generation element exceeds a threshold value.

Or else, each of the thermal condition detection circuits may include an outputting element for outputting an abnormal condition notification signal to the outside when the output of the corresponding temperature detection circuit representing the temperature of the corresponding unit heat generation element does not rise higher than a fixed level.

The above and other objects, features and advantages of the present invention will become apparent from the following description and the appended claims, taken in conjunction with the accompanying drawings in which like parts or elements are denoted by like reference characters.

DESCRIPTION OF THE PREFERRED EMBODIMENT

Figure 1:
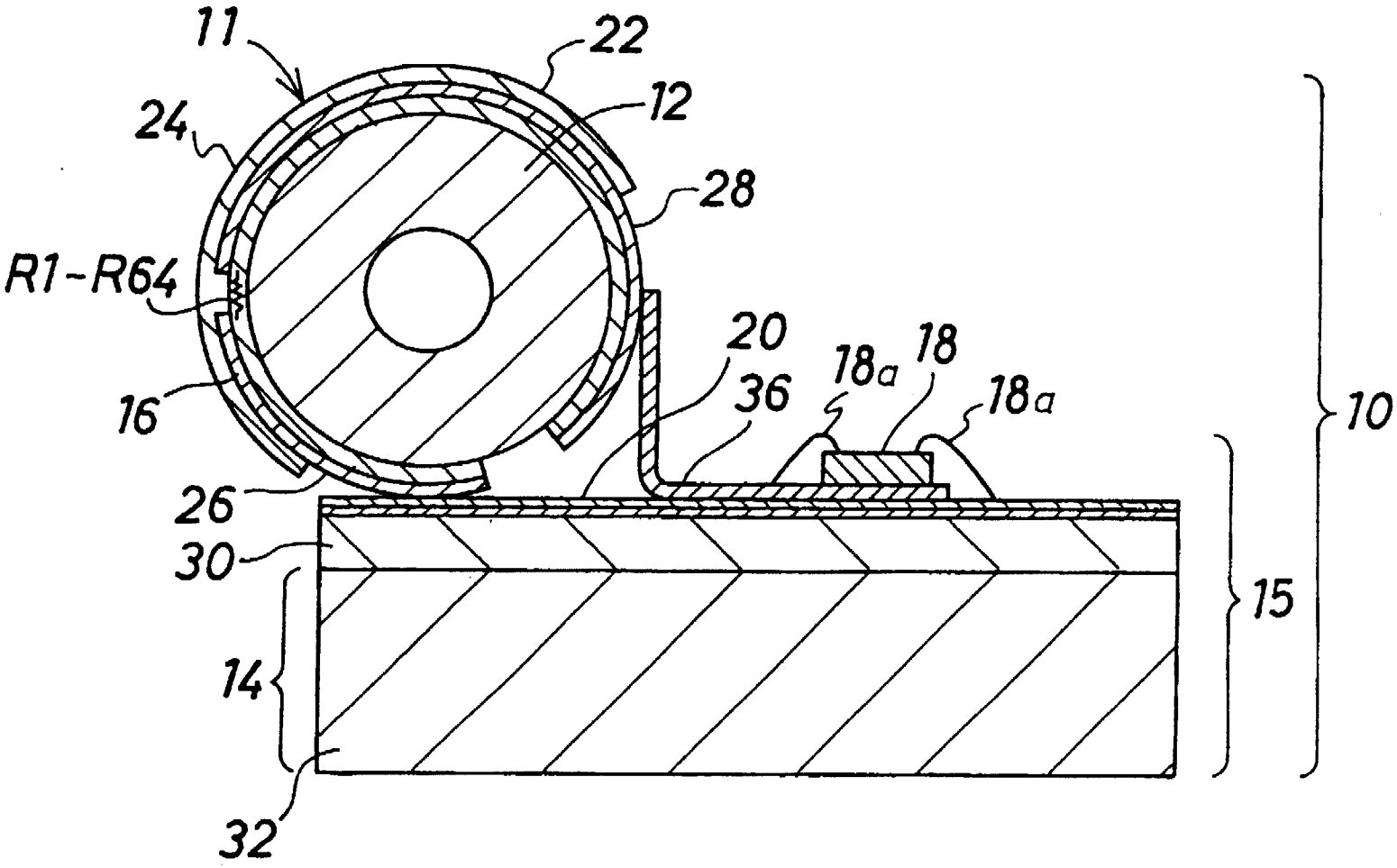
FIG. 1 is a cross sectional view of a thermal head apparatus showing a preferred embodiment of the present invention.

FIG. 1 is a sectional view showing a structure of a thermal head apparatus according to a preferred embodiment of the present invention. Referring to FIG. 1, the thermal head apparatus is generally denoted at 10 and includes a thermal head section 11 and a mounting circuit board section 15. The thermal head section 11 includes a cylindrical core 12 made of an insulating material such as alumina ceramics, 64 heat generation elements R1 to R64 arranged in a row parallel to an axial line of the core 12 on an outer surface of the core 12, and 64 core terminals 16 provided on the outer side of the heat generation elements R1 to R64 and connected to the heat generation elements R1 to R64, respectively. The heat generation elements R1 to R64 are each formed from a resistor member whose electric resistance has a high temperature dependency such as, for example, a thin film of an alumina alloy. A common electrode 22 is provided at another portion of the outer surface of the core 12 remote from the portion where the core terminals 16 are provided. The common electrode 22 is connected to all of the heat generation elements R1 to R64. All of the heat generation elements R1 to R64 and most part of the core terminals 16 and the common electrode 22 are covered with a protective film 24, and plated solders 26 and 28 are provided at portions of the core terminals 16 and the common electrode 22 which are not covered with the protective film 24, respectively.

The mounting circuit board section 15 includes an integrated circuit 18 mounted on a mounting circuit board 14. The integrated circuit 18 includes driving circuits for individually supplying electric currents to the heat generation elements R1 to R64 for a fixed period of time, temperature detection circuits for individually detecting the temperatures of the heat generation elements R1 to R64, and control circuits for individually controlling the heat generation elements and the driving circuits. The driving circuits, temperature detection circuits and control circuits are provided for the individual heat generation elements R1 to R64. The mounting circuit board 14 includes a flattened base plate 32 of a synthetic resin, and an insulator layer 30 made of an insulating material such as alumina ceramics and formed on the base plate 32. A number of mounting circuit board terminals 20 equal to the number of the core terminals 16 are provided in the same pitch as that of the core terminals 16 on the surface of the insulator layer 30. The mounting circuit board terminals 20 are plated with gold, and a flexible cable 36 is connected to them. The integrated circuit 18 is connected to the flexible cable 36 by way of gold wires 18*a*. The flexible cable 36 is connected also to an external control circuit section (not shown). It is to be noted that such external control circuit section may possibly be incorporated alternatively in the thermal head apparatus 10 shown in FIG. 1.

Figure 2:
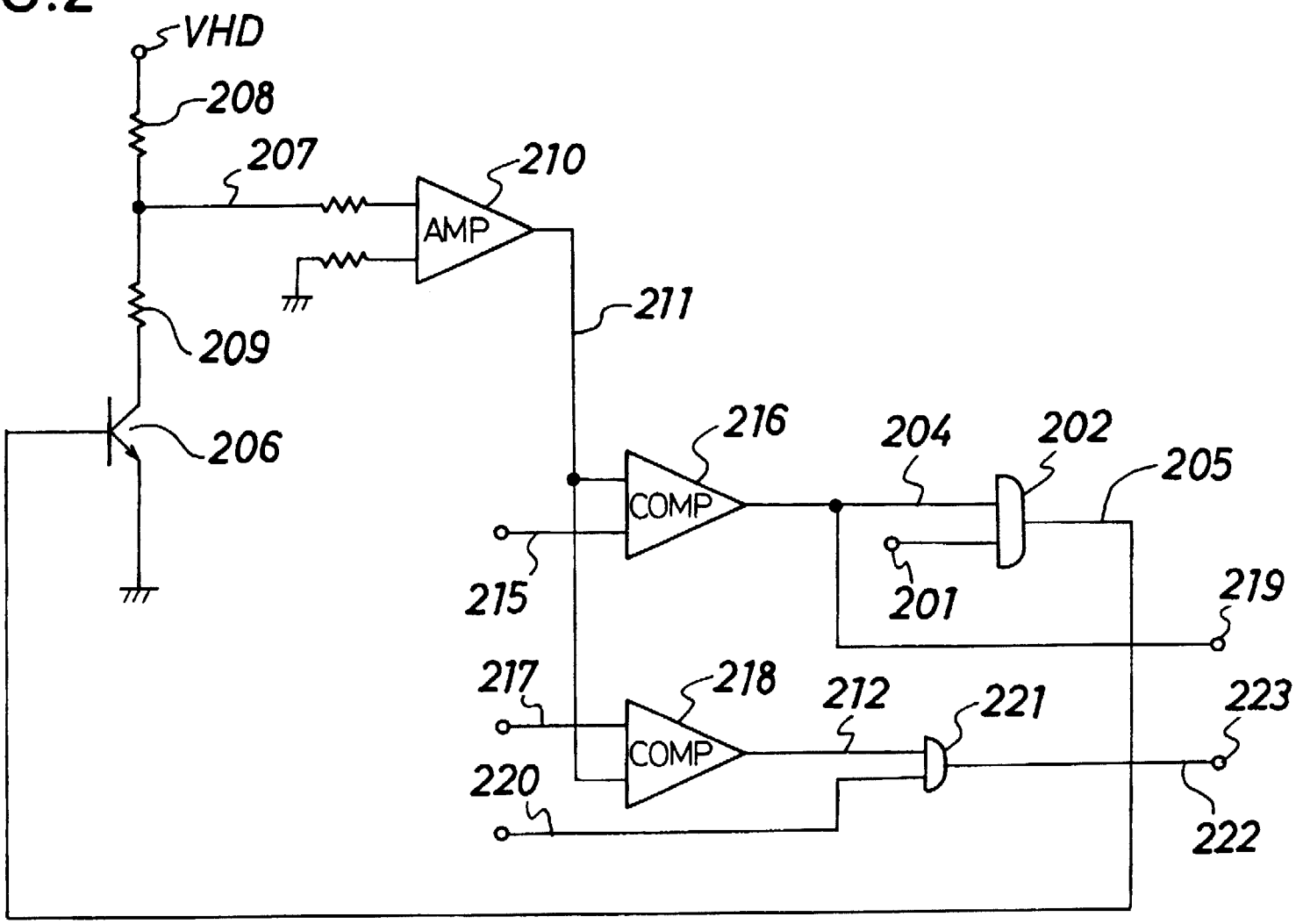
FIG. 2 is a circuit diagram showing a set of a driving circuit, a temperature detection circuit and a control circuit for one heat generation element of the thermal head apparatus of FIG. 1.
Figure 3A:
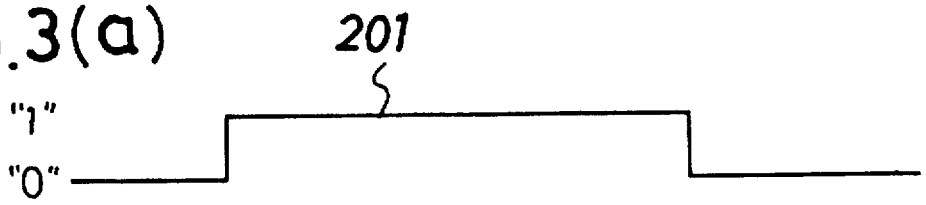
FIG. 3 which comprises FIG. 3(*a*)–FIG. 3(*g*) is a time chart illustrating operation of the circuit of FIG. 2.
Figure 3B:
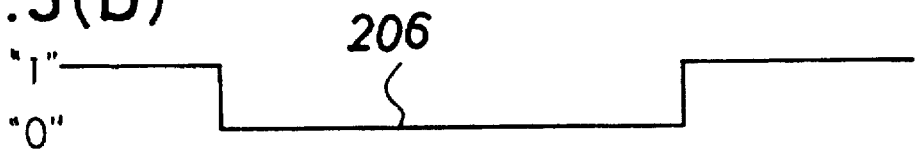
Figure 3C:
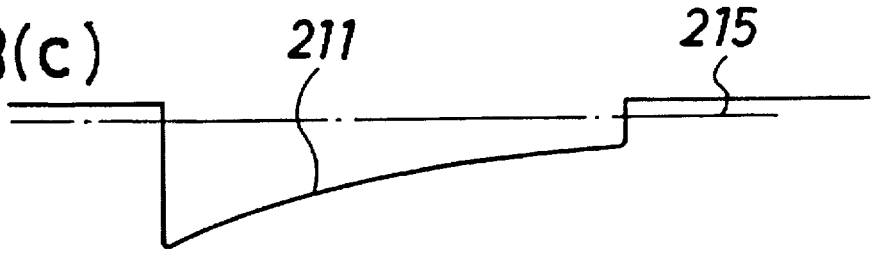
Figure 3D:
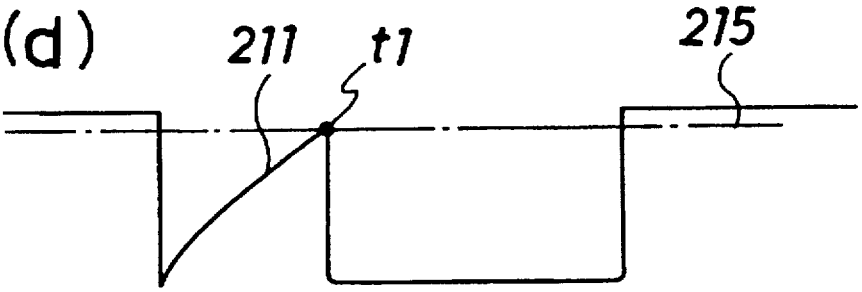
Figure 3E:
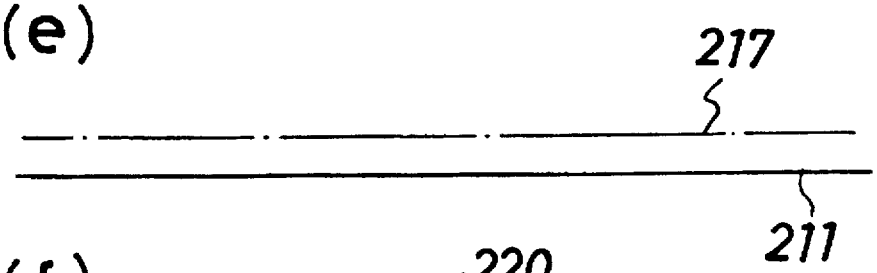
Figure 3F:
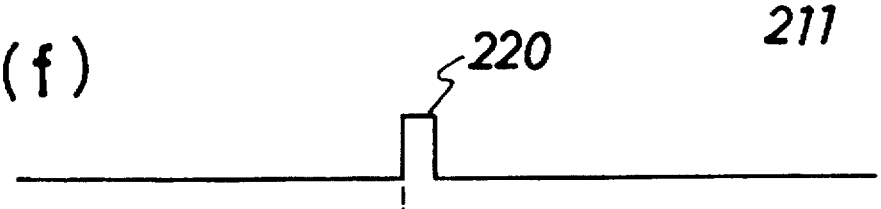
Figure 3G:
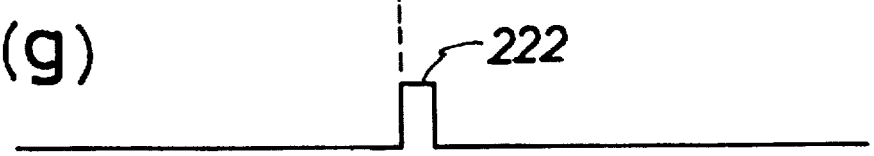

FIG. 2 shows a set of a driving circuit, a temperature detection circuit and a control circuit for each one of the heat generation elements. Such circuit is provided for each of the 64 heat generation elements R1 to R64. In FIG. 2, one heat generation element is shown as a single resistor 208.

Referring to FIG. 2, the resistor 208 as one heat generation element is connected at a terminal thereof to a dc power source not shown and connected at the other terminal thereof to the collector of a driving transistor 206 by way of a fixed resistor 209. Consequently, when the resistor 208 is turned on, electric current flows through the resistor 208 so that the resistor 208 generates heat. The electric current then depends almost upon the resistance value of the resistor 208 and a dc voltage VHD applied to the resistor 208. Further, a voltage obtained by dividing the dc voltage VHD by the resistor 208 and the fixed resistor 209 appears across the resistor 208. This voltage varies depending upon the temperature of the fixed resistor 209 (when the temperature of the resistor 208 rises to decrease the resistance value, the voltage rises) since the resistance value of the resistor 208 varies depending upon the temperature, and a detection signal 207 corresponding to the temperature of the resistor 208 can be extracted from a junction between the resistor 208 and the fixed resistor 209. Since the Junction is connected to one of a pair of input terminals of an amplification circuit 210, an amplification signal 211 obtained by amplification of the detection signal 207 is outputted from the amplification circuit 210.

The amplification signal 211 is inputted to a first comparison circuit 216 and a second comparison circuit 218. In the first comparison circuit 216, the amplification signal 211 is compared with a reference signal 215 set to a high threshold value while, in the second comparison circuit 218, the amplification signal 211 is compared with another reference signal 217 set to a low threshold value. An output signal 204 representing a result of the detection of the first comparison circuit 216 is outputted to a first AND gate 202 together with a driving signal 201 from the outside, and is outputted also as a first abnormal condition notification signal from a first output terminal 219 to the outside. An output signal 205 of the first AND gate 202 is inputted to the base of the driving transistor 206 so that the driving transistor 206 is turned on or off in response to the output signal 205. Meanwhile, an output signal 212 representing a result of the comparison of the second comparison circuit 218 is inputted to a second AND gate 221 together with a cyclic timing signal 220 from the outside. An output signal 222 of the second AND gate 221 is outputted as a second abnormal condition notification signal from a second output terminal 223 to the outside.

Operation of the circuit having the construction described above will be described below with reference to the time chart of FIG. 3. It is to be noted that, in the following description, when the signal level in the time chart of FIG. 3 is HIGH, the logical value is "1" and when the signal level is LOW, the logical value is "0".

In an initial state, the output signal of the first comparison circuit 216 is "1". Accordingly, when the driving signal 201 from the outside changes to "1" in the waveform (a) of FIG. 3, also the output of the first AND gate 202 changes to "1", and the driving transistor 206 changes from "1" to "0" in the waveform (b) of FIG. 3, that is, the driving transistor 206 is turned on. Consequently, the resistor 208 serving as a heat generation element is energized to generate heat.

Since the resistor 208 itself serves as a heat generation element and also as a temperature detection element whose resistance value varies depending upon the temperature thereof, when the temperature of it rises, the voltage of the detection signal 207 rises. Consequently, also the amplification signal 211 outputted from the amplification circuit 210 as a result of amplification of the detection signal 207 rises as the temperature of the resistor 208 rises as seen from the waveform (c) of FIG. 3.

When the resistor 208 (heat generation element) generates heat to raise the temperature thereof gradually in an ordinary operation, where thermosensible paper is used, a portion of the thermosensible paper corresponding to the resistor 208 develops a color to form a dot, but in heat transfer printing, ink at a portion of an ink film corresponding to the resistor 208 is melted and sticks to the surface of print paper to form a dot.

Such heat generation of the resistor 208 comes to an end when the driving signal 201 from the outside changes from "1" to "0" as seen from the waveform (a) of FIG. 3, whereupon also the output of the first AND gate 202 changes from "1" to "0" and the driving transistor 206 is turned off.

If a fine foreign article which obstructs a normal printing operation such as a fine metal piece, a hair, a minute stone piece or a fine piece of paper is present on the front surface or the rear surface of, for example, thermosensible paper sheet or a thermal transfer ink film, heat from the resistor 208 is prevented from being transmitted regularly to the thermosensible paper or the heat transfer ink film by the foreign article. Consequently, the temperature of the resistor 208 itself rises rapidly, and also the voltage of the detection signal 207 rises rapidly. The amplification signal 211 from the amplification circuit 210 by which the detection signal 207 is amplified is inputted to the first comparison circuit 216, in which it is compared with the reference signal 215 of the high threshold value as seen from the waveform (c) of FIG. 3.

When the amplification signal 211 becomes higher than the reference signal 215 at the first comparison circuit 216 (time t1), as shown in waveform (d) of FIG. 3, the output signal 204 of the first comparison circuit 216 changes to "0". Consequently, the output signal 205 of the first AND gate 202 changes to "0" and the driving transistor 206 is turned off. As a result, generation of heat of the resistor 208 is stopped. In this instance, the output signal 204 of the first comparison circuit 216 is outputted also to the outside from the first output terminal 219 so that it is notified to the outside that the resistor (heat generation element) 208 is in an abnormally high temperature condition. Consequently, the driving signal 201 from the outside will be changed from "1" to "0" and the driving transistor 206 will continue its off state.

On the other hand, if the characteristic of a particular one of the 64 resistors (heat generation elements) is varied to that different from that of the other resistors (heat generation elements) so that the heat generation element generates a reduced amount of heat or if a driving circuit for a particular one of the resistors (heat generation elements) 208 is disconnected so that it does not generate heat any more, then the amplification signal 211 does not exhibit a voltage rise any more as seen from the waveform (e) of FIG. 3. The amplification signal 211 is compared with the reference signal 217 of the low threshold value from the outside by the second comparison circuit 218. However, since the amplification signal 211 does not rise higher than the threshold value then, the output signal 212 of the second comparison circuit 218 exhibits the value "1" The output signal 212 is inputted to one of a pair of input terminals of the second AND gate 221. Since such a timing signal 220 as seen from the waveform (f) of FIG. 3 is inputted cyclically from the outside to the other input terminal of the second AND gate 221, such an output signal 222 as seen from the waveform (g) of FIG. 3 is outputted from the second AND gate 221 in synchronism with the thus inputted timing signal 220. The output signal 222 is outputted from the second output terminal 223 to the outside so that it is notified to the outside that the resistor (heat generation element) 208 does not generate heat regularly.

It is to be noted that, while the thermal head apparatus in the embodiment described above is formed as a line head apparatus wherein the heat generation elements R1 to R64 are arranged in a row such that they may operate to print at a time on paper along a lateral line perpendicular to the direction in which the paper is fed, the present invention can be applied also to a serial head wherein heat generation elements are arranged in a row parallel to a paper feeding direction and print while being moved in a lateral direction perpendicular to the paper feeding direction.

Having now fully described the invention, it will be apparent to one of ordinary skill in the art that many changes and modifications can be made thereto without departing from the spirit and scope of the invention as set forth herein.

What is claimed is:

1. A thermal head apparatus, comprising:

a plurality of heat generation elements comprising unit heat generation elements which each comprise a resistor member whose electric resistance value varies depending upon a temperature of said resistor member, said unit heat generation elements being arranged in a row;

a driving circuit provided for each of said unit heat generation elements for supplying an electric current to a corresponding unit heat generation element;

a temperature detection circuit provided for each of said unit heat generation elements for extracting, from the corresponding unit heat generation element, an electric signal which is obtained as a result of a variation of an electric resistance value caused by a variation in a temperature of the corresponding unit heat generation element; and an abnormal condition detection circuit provided for each of said unit heat generation elements for detecting a presence or an absence of an abnormal condition of the corresponding unit heat generation element from an output of a corresponding temperature detection circuit;

wherein said abnormal condition detection circuit includes an outputting element for outputting an abnormal condition notification signal outside of the thermal head apparatus in synchronism with a timing signal inputted cyclically to the abnormal condition detection circuit.

2. A thermal head apparatus as claimed in claim 1, wherein said resistor member comprises a thin film alumina alloy.

3. A thermal head apparatus as claimed in claim 1, wherein said abnormal condition notification signal is output when the output of the corresponding temperature detection circuit representing the temperature of the corresponding unit heat generation element does not rise higher than a fixed level.

4. A thermal head apparatus, comprising:

a plurality of heat generation elements comprising unit heat generation elements which each comprise a resistor member whose electric resistance value varies depending upon a temperature of said resistor member, said unit heat generation elements being arranged in a row;

a driving circuit provided for each of said unit heat generation elements for supplying an electric current to a corresponding unit heat generation element;

a temperature detection circuit provided for each of said unit heat generation elements for extracting, from the corresponding unit heat generation element, an electric signal which is obtained as a result of a variation of an electric resistance value caused by a variation in a temperature of the corresponding unit heat generation element itself; and an abnormal condition detection circuit provided for each of said unit heat generation elements for detecting a presence or an absence of an abnormal condition of a corresponding unit heat generation element from an output of a corresponding temperature detection circuit;

wherein the abnormal condition detection circuit includes an outputting element for outputting an abnormal condition notification signal outside of the thermal head apparatus when the output of the corresponding temperature detection circuit representing the temperature of the corresponding unit heat generation element exceeds a threshold value.

5. A thermal head apparatus comprising:

a plurality of heat generation elements comprising unit heat generation elements which each comprise a resistor member whose electric resistance value varies depending upon a temperature of said resistor member, said unit heat generation elements being arranged in a row;

a driving circuit provided for each of said unit heat generation elements for supplying an electric current to a corresponding unit heat generation element;

a temperature detection circuit provided for each of said unit heat generation elements for extracting, from the corresponding unit heat generation element, an electrical signal which is obtained as a result of a variation of an electric resistance value caused by a variation in a temperature of the corresponding unit heat generation element; and an abnormal condition detection circuit provided for each of said unit heat generation elements for detecting a presence or an absence of an abnormal condition of the corresponding unit heat generation element from an output of a corresponding temperature detection circuit;

wherein the abnormal condition detection circuit includes an outputting element for outputting an abnormal condition notification signal outside of the thermal head apparatus when the output of the corresponding temperature detection circuit representing the temperature of the corresponding unit heat generation element does not rise higher than a fixed level.

6. A thermal head apparatus as claimed in claim 5, wherein each of the abnormal condition detection circuits includes a control element for turning a corresponding driving circuit off when the output of the corresponding temperature detection circuit representing the temperature of the corresponding unit heat generation element exceeds a threshold value.

* * * * *